US006468365B1

(12) United States Patent
Uchida et al.

(10) Patent No.: US 6,468,365 B1
(45) Date of Patent: Oct. 22, 2002

(54) R-T-B SINTERED PERMANENT MAGNET

(75) Inventors: Kimio Uchida, Saitama-ken (JP); Tsunehiro Kawata, Saitama-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/417,544

(22) Filed: Oct. 14, 1999

(30) Foreign Application Priority Data

Oct. 14, 1998 (JP) ..... 10-307841

(51) Int. Cl.[7] ..... H01F 1/053
(52) U.S. Cl. ..... 148/302; 75/244
(58) Field of Search ..... 148/302; 75/244

(56) References Cited

U.S. PATENT DOCUMENTS 5,034,146 A 7/1991 Ohashi et al.
5,055,129 A 10/1991 Ghandehari
5,405,455 A 4/1995 Kusunoki et al.
5,595,608 A * 1/1997 Takebuchi et al. ..... 148/104

FOREIGN PATENT DOCUMENTS

JP 07122413 A 10/1993
JP 09232121 A 2/1996

* cited by examiner

*Primary Examiner*—John Sheehan
*Assistant Examiner*—Andrew L. Oltmans
(74) *Attorney, Agent, or Firm*—Sughrue Mion, PLLC

(57) ABSTRACT

An R—T—B sintered permanent magnet having a composition including 28–33 weight % of R, and 0.5–2 weight % of B, the balance being substantially T and inevitable impurities, wherein R is at least one rare earth element including Y, at least one heavy rare earth element selected from the group consisting of Dy, Tb and Ho being indispensable, and T is Fe or Fe and Co, the permanent magnet having a crystal structure comprising first $R_2T_{14}B$-type, main-phase crystal grain particles having a higher heavy rare earth element concentration than that of a crystal grain boundary phase, and second $R_2T_{14}B$-type, main-phase crystal grain particles having a lower heavy rare earth element concentration than that of the crystal grain boundary phase.

13 Claims, 8 Drawing Sheets

R-T-B SINTERED PERMANENT MAGNET

FIELD OF THE INVENTION

The present invention relates to an R—T—B sintered permanent magnet having high coercivity, residual magnetic flux density and maximum energy product.

DESCRIPTION OF PRIOR ART

With respect to R—T—B sintered permanent magnets, wherein R is at least one rare earth element including Y, and T is Fe or Fe and Co, those having maximum energy products of about 40 MGOe are mass-produced. Means for adjusting the alloy compositions of the R—T—B sintered permanent magnets include a single method and a blend method.

The single method is a method for producing an R—T—B sintered permanent magnet using an ingot adjusted to have a main component composition of an R—T—B sintered permanent magnet at a melting and/or casting stage, through the steps of pulverization, molding in a magnetic field, sintering and heat treatment. The resultant R—T—B sintered permanent magnet is subjected to predetermined machining and surface treatment for use in practical applications.

The blend method is a method for producing an R—T—B sintered permanent magnet through the steps of mixing of two or more types of R—T—B sintered permanent magnet powder having different compositions at such a formulation as to provide the final R—T—B sintered permanent magnet with a desired main component composition, pulverization, if necessary, and further molding in a magnetic field, sintering, heat treatment and surface treatment.

The above single method can relatively easily provide sintered permanent magnets with a high coercivity iHc, their residual magnetic flux density Br and maximum energy product $(BH)_{max}$ are low, unsuitable for applications requiring high Br and $(BH)_{max}$.

Though conventionally proposed as applications of the blend method are an R—T—B sintered permanent magnet produced from an R—T alloy having a high R content and an R—T—B alloy having a low R content (Japanese Patent Laid)pen No. 7-122413), and an R—T—B sintered permanent magnet in which Ga, C and O are segregated in an R-rich phase and its vicinity (Japanese Patent Laid-Open No. 9-232121). However, there is still room for improvement to make them suitable for high-Br, high $(BH)_{max}$ applications. Particularly with respect to heavy rare earth elements having large influence on magnetic properties, their optimum concentration distributions in main phase particles and their control have not yet been made clear.

OBJECT AND SUMMARY OF THE INVENTION

Accordingly, an object of the present invention is to provide a high-performance R—T—B sintered permanent magnet suitable for applications requiring high Br and $(BH)_{max}$.

Thus, the R—T—B sintered permanent magnet according to the present invention has a composition comprising 28–33 weight % of R, and 0.5–2 weight % of B, the balance being substantially T and inevitable impurities, wherein R is at least one rare earth element including Y, at least one heavy rare earth element selected from the group consisting of Dy, Th and Ho being indispensable, and T is Fe or Fe and Co, the permanent magnet having a crystal structure comprising first $R_2T_{14}B$-type, main-phase crystal grain particles having a higher heavy rare earth element concentration than that of a crystal grain boundary phase, and second $R_2T_{14}B$-type, main-phase crystal grain particles having a lower heavy rare earth element concentration than that of the crystal grain boundary phase.

In a preferred embodiment of the present invention, the R—T—B sintered permanent magnet has a composition comprising 28–33 weight % of R, 0.5–2 weight % of B, and 0.01–0.6 weight % of $M_1$, wherein $M_1$ is at least one element selected from the group consisting of Nb, Mo, W, V, Ta, Cr, Ti, Zr and Hf, the balance being substantially T and inevitable impurities.

In another preferred embodiment of the present invention, the R—T—B sintered permanent magnet has a composition comprising 28–33 weight % of R, 0.5–2 weight % of B, 0.01–0.6 weight % of $M_1$, and 0.01–0.3 weight % of $M_2$, the balance being substantially T and inevitable impurities, wherein M, is at least one element selected from the group consisting of Nb, Mo, W, V, Ta, Cr, Ti, Zr and Hf, and $M_2$ is at least one element selected from the group consisting of Al, Ga and Cu.

In a further preferred embodiment of the present invention, the R—T—B sintered permanent magnet comprises more than 31% and 33% or less by weight of R, with 0.6 weight % or less of oxygen, 0.15 weight % or less of carbon, 0.03 weight % or less of nitrogen and 0.3 weight % or less of Ca as inevitable impurities.

In a still further preferred embodiment of the present invention, the R—T—B sintered permanent magnet comprises 28–31 weight % of R with 0.25 weight % or less of oxygen, 0.15 weight % or less of carbon, 0.15 weight % or less of nitrogen and 0.3 weight % or less of Ca as inevitable impurities.

The R—T—B sintered permanent magnet of the present invention is produced, for instance, by the steps of mixing of two types or more of alloy powder having substantially the same composition except for the difference in a ratio of heavy rare earth elements (Dy, etc.)/light rare earth elements (Nd, Pr, etc.) with the same total amount of the rare earth elements, molding in a magnetic field, sintering, heat treatment, and if necessary, machining, finish working such as barreling, etc., and surface treatment such as Ni plating, etc. Depending on the compositions of the above two types or more of alloy powder and the final composition of the R—T—B sintered permanent magnet, the optimum sintering conditions are selected to strictly control the diffusion of heavy rare earth elements such as Dy in the crystal structure of the sintered magnet. As a result, the crystal structure has a characteristic concentration distribution of heavy rare earth elements such as Dy in the $R_2T_{14}B$-type, main-phase crystal grain particles (substantially in center portions) and the crystal grain boundary phase, containing $R_2T_{14}B$-type, main-phase crystal grain particles having a higher concentration of heavy rare earth elements such as Dy than that of the crystal grain boundary phase, and $R_2T_{14}B$-type, main-phase crystal grain particles having a lower concentration of heavy rare earth elements such as Dy than that of the crystal grain boundary phase.

The R—T—B sintered permanent magnet having such a sintered crystal structure has extremely larger Br and $(BH)_{max}$ than those of the R—T—B sintered permanent magnet produced by the single method, though its coercivity iHc is slightly smaller than that of the latter. Though the correlation between such high magnetic properties and the concentration distribution of heavy rare earth elements such as Dy has not been fully clarified yet, it is presumed that the $R_2T_{14}B$-type, main-phase crystal grain particles having a higher concentration of heavy rare earth elements such as Dy than that of the crystal grain boundary phase contributes to achieving high Br, while the $R_2T_{14}B$-type, main-phase crystal grain particles having a lower concentration of heavy rare earth elements such as Dy than that of the crystal grain boundary phase contributes to achieving high iHc close to that obtained by the single method.

BRIEF DESCRIPTION OF THE DRAWINGS

FIG. 4(*b*) is an EPMA photograph showing the concentration distribution of Dy in the crystal structure of the R—T—B sintered permanent magnet of EXAMPLE 7;

FIG. 4(*c*) is an EPMA photograph showing the concentration distribution of Nd in the crystal structure of the R—T—B sintered permanent magnet of EXAMPLE 7;

FIG. 4(*d*) is an EPMA photograph showing the concentration distribution of Pr in the crystal structure of the R—T—B sintered permanent magnet of EXAMPLE 7;

DETAILED DESCRIPTION OF THE PREFERRED EMBODIMENTS

Figure 1:
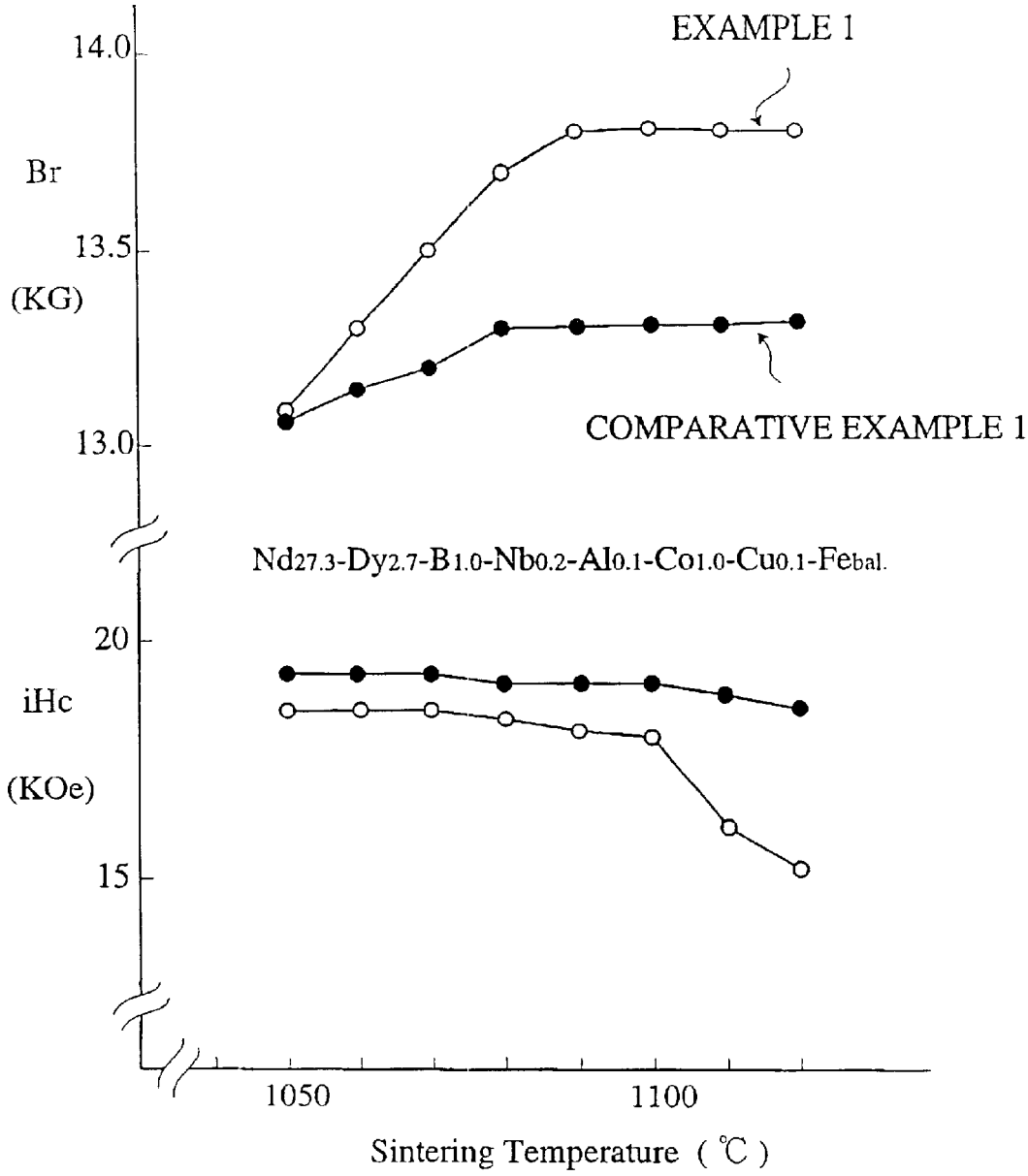
FIG. 1 is a graph showing the relation between a sintering temperature and magnetic properties (Br, iHc) in the R—T—B sintered permanent magnets of EXAMPLE 1 and COMPARATIVE EXAMPLE 1.

1 R—T—B Sintered Permanent Magnet (A) Composition (a) Main Components

The R—T—B sintered permanent magnet of the present invention comprises main components comprising 28–33 weight % of R, 0.5–2 weight % of B and the balance being substantially T, and inevitable impurities. In addition, 0.01–0.6 weight % of $M_1$, wherein $M_1$ is at least one element selected from the group consisting of Nb, Mo, W, V, Ta, Cr, Ti, Zr and Hf, and 0.01–0.3 weight % of $M_2$, wherein $M_2$ is at least one element selected from the group consisting of Al, Ga and Cu are preferably contained as main components.

(1) R Element

The R element is at least one rare earth element including Y, and it contains as an indispensable element at least one heavy rare earth element selected from the group consisting of Dy, Tb and Ho. Other rare earth elements (including Y) than the heavy rare earth elements may be Nd, Pr, La, Sm, Ce, Eu, Gd, Er, Tm, Yb, Lu and Y. Mixtures of two or more rare earth elements such as misch metals or didymium may also be used as the rare earth elements. The R content is 28–33 weight %. When the R content is less than 28 weight %, as high iHc as suitable for actual use cannot be obtained. On the other hand, when it exceeds 33 weight %, Br decreases drastically.

The total content of the heavy rare earth elements is preferably within the range of 0.2–15 weight %. When the total content of the heavy rare earth elements is less than 0.2 weight %, it is impossible to obtain sufficiently improvement in magnetic properties due to the distribution of the heavy rare earth elements in the crystal structure. On the other hand, when the total content of the heavy rare earth elements exceeds 15 weight %, the R—T—B sintered permanent magnet shows largely decreased Br and $(BH)_{max}$. The more preferred total content of the heavy rare earth elements is 0.5–13 weight %.

(2) B

The content of B is 0.5–2 weight %. When the content of B is less than 0.5 weight %, as high iHc as suitable for actual use cannot be obtained. On the other hand, when it exceeds 2 weight %, Br decreases drastically.

(3) T Element

The T element is Fe alone or Fe+Co. The addition of Co serves to provide the sintered permanent magnet with an improved corrosion resistance, and elevate its Curie temperature thereby improving a heat resistance as a permanent magnet. However, when the content of Co exceeds 5 weight %, an Fe—Co phase harmful to the magnetic properties of the R—T—B sintered permanent magnet is formed, resulting in decrease in Br and iHc. Accordingly, the content of Co is 5 weight % or less. On the other hand, when the content of Co is less than 0.5 weight %, the effects of improving corrosion resistance and heat resistance are insufficient. Thus, when Co is added, the content of Co is preferably 0.5–5 weight %.

(4) $M_1$ Element

The $M_1$ element is at least one high-melting point metal element selected from the group consisting of Nb, Mo, W, V, Ta, Cr, Ti, Zr and Hf. The presence of the $M_1$ element suppresses the excessive growth of the main-phase crystal grain particles formed by the diffusion of the heavy rare earth elements such as Dy in a sintering process, thereby stably providing high iHc close to that obtained by the single method. However, when the $M_1$ element is excessively added, the healthy growth of the main-phase crystal grain particles is rather suppressed, resulting in decrease in Br. Thus, the content of the $M_1$ element is at most 0.6 weight %. On the other hand, when the content of the $M_1$ element is less than 0.01 weight %, sufficiently effects cannot be obtained. Thus, the content of the $M_1$ element is preferably 0.01–0.6 weight %.

(5) $M_2$ Element

The $M_2$ element is at least one element selected from the group consisting of Al, Ga and Cu.

The addition of a trace amount of Al serves to improve iHc and corrosion resistance of the R—T—B sintered permanent magnet. However, when the content of Al exceeds 0.3 weight %, Br decreases drastically. Thus, the content of Al is 0.3 weight % or less. On the other hand, when the content of Al is less than 0.01 weight %, sufficiently effects of improving iHc and corrosion resistance cannot be obtained.

The addition of a trace amount of Ga serves to drastically improve iHc of the R—T—B sintered permanent magnet.

However, when the content of Ga exceeds 0.3 weight %, Br decreases drastically like Al. Thus, the content of Ga is 0.3 weight % or less. On the other hand, when the content of Ga is less than 0.01 weight %, significant effects of improving iHc cannot be obtained.

The addition of a trace amount of Cu serves to improve iHc and corrosion resistance of the sintered magnet. However, when the content of Cu exceeds 0.3 weight %, Br of the R—T—B sintered permanent magnet decreases drastically like Al and Ga. On the other hand, when the content of Cu is less than 0.01 weight %, sufficiently effects of improving iHc and corrosion resistance cannot be obtained.

As described above, the content of the $M_2$ element, either Al, Ga or Cu, is 0.01–0.3 weight %.

(b) Inevitable Impurities

The inevitable impurities include oxygen, carbon, nitrogen, calcium, etc. When two types or more of R—T—B alloys having different heavy rare earth element contents are produced by a reduction diffusion method, Ca enters into them as an inevitable impurity. The reduction diffusion method is a method for producing the alloy powder by reducing powder of rare earth element oxides with a reducing agent (Ca), and then subjecting the resultant rare earth element metal powder to mutual diffusion with other main component metals.

The content of oxygen is preferably 0.6 weight % or less, the content of carbon is preferably 0.15 weight % or less, the content of nitrogen is preferably 0.15 weight % or less, and the content of calcium is preferably 0.3 weight % or less. When the content of each inevitable impurity exceeds each above upper limit, the R—T—B sintered permanent magnet has decreased magnetic properties. More preferable contents of inevitable impurities are such that oxygen is 0.25 weight % or less, carbon is 0.15 weight % or less, and nitrogen is 0.03 weight % or less. Particularly preferable contents of inevitable impurities are such that oxygen is 0.05–0.25 weight %, carbon is 0.01–0.15 weight %, and nitrogen is 0.02–0.15 weight %.

Specific examples of compositions of the R—T—B sintered permanent magnets containing such inevitable impurities are as follows:

(i) A composition comprising, by weight, more than 31% and 33% or less of R, 0.6% or less of oxygen, 0.15% or less of carbon, 0.03% or less of nitrogen, and 0.3% or less of Ca. For instance, a dry molding method can provide 0.25–0.6% of oxygen, 0.01–0.15% of carbon and 0.005–0.03% of nitrogen.

(ii) A composition comprising, by weight, 28–31% of R, 0.25% or less of oxygen, 0.15% or less of carbon, 0.15% or less of nitrogen, and 0.3% or less of Ca. For instance, a wet molding method can provide 0.05–0.25% of oxygen, 0.01–0.15% of carbon and 0.02–0.15% of nitrogen.

(B) Crystal Structure

The crystal structure of the R—T—B sintered permanent magnet of the present invention comprises $R_2T_{14}B$-type, main-phase crystal grain particles and a crystal grain boundary phase, and the $R_2T_{14}B$-type, main-phase crystal grain particles. comprises at least (i) first $R_2T_{14}B$-type, main-phase crystal grain particles having a higher concentration of heavy rare earth elements than that of the crystal grain boundary phase, and (ii) second $R_2T_{14}B$-type, main-phase crystal grain particles having a lower concentration of heavy rare earth elements than that of the crystal grain boundary phase. The above $R_2T_{14}B$-type, main-phase crystal grain particles may further contain (iii) third $R_2T_{14}B$-type, main-phase crystal grain particles having substantially the game concentration of heavy rare earth elements as that of the crystal grain boundary phase. The concentration of heavy rare earth elements in the $R_2T_{14}B$-type, main-phase crystal grain particles is measured substantially in their core portions, namely substantially in their center portions. A core portion of an $R_2T_{14}B$-type, main-phase crystal grain particle is defined as a region of the $R_2T_{14}B$-type, main-phase crystal grain particle away from its crystal grain boundary by 1.0 $\mu$m or more. The heavy rare earth element is preferably Dy, though it may be Tb and/or Ho, or their mixtures with Dy.

When the number of each type of $R_2T_{14}B$-type, main-phase crystal grain particles is expressed by percentage per the total number (100%) of the $R_2T_{14}B$-type, main-phase crystal grain particles in a cross section photograph of the crystal structure, it is preferable that the number of the first $R_2T_{14}B$-type, main-phase crystal grain particles is 1–35%, the number of the second $R_2T_{14}B$-type, main-phase crystal grain particles is 3–55%, and the number of the third $R_2T_{14}B$-type, main-phase crystal grain particles is 96–10%. When any of the first to third $R_2T_{14}B$-type, main-phase crystal grain particles are outside the above percentage range of number, it is not easy to provide the R—T—B sintered permanent magnet with high coercivity iHc, residual magnetic flux density Br and maximum energy product $(BH)_{max}$. More preferably, the number of the first $R_2T_{14}B$-type, main-phase crystal grain particles is 3–30%, the number of the second $R_2T_{14}B$-type, main-phase crystal grain particles is 10–45%, and the number of the third $R_2T_{14}B$-type, main-phase crystal grain particles is 87–25%.

2 Production Method

To produce the R—T—B sintered permanent magnet of the present invention having the above crystal structure, a so-called blend method is used, in which two types or more of R—T—B alloy powder having different concentrations of heavy rare earth elements such as Dy are mixed. In this case, the total amount of the rare earth elements does not preferably differ from one R—T—B alloy powder to the other. For instance, in the case of Nd+Dy, one alloy powder contains 29.0% Nd+1.0% Dy, while the other alloy powder contains 15.0% Nd+15.0% Dy as shown in EXAMPLE 1 below. With respect to other elements than the rare earth elements, it is preferable that there is substantially no difference in their concentrations between each alloy powder, though slight differences may exist in the content of $M_1$ and/or $M_2$.

For instance, in the case of mixing two types of alloy powder, it is preferable that the total amount oaf the rare earth elements is the same between them, that the concentration of a heavy rare earth element in the fist alloy powder is 0–10 weight %, and the concentration of a heavy rare earth element in the second alloy powder is more than 10 weight % and 40 weight % or less. In this case, a ratio of the first alloy powder/the second alloy powder is preferably 70/30 to 95/5 by weight, more preferably 80/20 to 90/10 by weight. This is because as the difference between the first alloy powder and the second alloy powder in the content of heavy rare earth elements increases, differences become large in fine pulverizability (particle size distribution of fine powder) between the first alloy powder and the second alloy powder, resulting in widening particle size distribution of main-phase crystal grain particles in the R—T—B sintered permanent magnet finally formed, leading to deterioration in a squareness ratio of a demagnetization curve, which shows the relation of the intensity of magnetization ($4\pi I$) and the intensity of magnetic field (H), and $(BH)_{max}$.

The fine pulverization of the R—T—B alloy powder may be carried out by a dry pulverization method such as jet milling, etc. using an inert gas as a pulverization medium, or a wet pulverization method such as ball milling, etc. To achieve high magnetic properties, it is preferable to conduct fine pulverization by a jet mill in an inert gas atmosphere containing substantially no oxygen (concentration: 1000 ppm or less by volume), and recover the resultant fine powder directly from the inert gas atmosphere into a mineral oil, a synthetic oil, a vegetable oil or their mixtures without bringing the fine powder into contact with the air, thereby providing a mixture (slurry). By preventing the fine powder from being in contact with the air, it is possible to suppress oxidation and the adsorption of moisture. The mineral oils, the synthetic oils and the vegetable oils preferably have distillation points of 350° C. or lower and a kinetic viscosity of 10 cSt or less, more preferably 5 cSt or less at room temperature, from the aspect of oil removal and moldability.

The mixture (slurry) is wet-molded in a magnetic field by a desired molding apparatus and then dried to obtain a green body. To suppress the deterioration of magnetic properties by oxidation, the green body is preferably kept in oil or in an inert gas atmosphere from immediately after molding to charging into a sintering furnace. The molding may be carried out by a dry method. In the case of a dry molding method, a dry fine powder mixture is pressed in a magnetic field in an inert gas atmosphere.

In the sintering of the wet-formed green body, drastic temperature elevation from room temperature to a sintering temperature causes a mineral oil, a synthetic oil or a vegetable oil remaining in the green body to react with the rare earth element to form rare earth carbides, thereby deteriorating the magnetic properties of the resultant sintered magnet. To cope with this problem, it is desirable to carry out an oil removal treatment at a temperature of 100–500° C. and a vacuum degree of $10^{-1}$ Torr or less for 30 minutes or more. By the oil removal treatment, the remaining mineral oil, synthetic oil or vegetable oil can be fully removed from the green body. Incidentally, as long as the heating temperature is within a range of 100–500° C., it needs not to be constant. Also, during temperature elevation from room temperature to 500° C. at a vacuum degree of $10^{-1}$ Torr or less, the temperature elevation speed may be 10° C./minute or less, preferably 5° C./minute or less, to achieve substantially the same oil removal effects.

Sintering of the green body at about 1000–1200° C. in an inert gas atmosphere provides an R—T—B sintered permanent magnet. The resultant R—T—B sintered permanent magnet is subjected to machining and surface treatment, if necessary. The surface treatment may be Ni plating, epoxy resin deposition, etc.

The present invention will be described in detail referring to EXAMPLES below without intention of limiting the present invention thereto.

EXAMPLE 1

Each of cast alloys A and B having main component compositions shown in Table 1 was coarsely pulverized in an inert gas atmosphere, and sieved to provide coarse powder having a particle size of 500 μm or less. 87.9 kg of coarse powder of the alloy A and 12.1 kg of coarse powder of the alloy B were charged into a V-type blender to provide 100 kg of mixed coarse powder. As a result of analysis of this mixed coarse powder with respect to composition the main components of this mixed coarse powder were 27.3 weight % of Nd, 2.7 weight % of Dy, 1.0 weight % of B, 0.2 weight % of Nb, 0.1 weight % of Al, 1.0 weight % of Co, and 0.1 weight % of Cu, the balance being substantially Fe, and that impurities contained in this mixed coarse powder were 0.15 weight % of O, 0.01 weight % of N, and 0.02 weight % of C.

TABLE 1

| | Composition (weight %) | | | | | | | |
|---|---|---|---|---|---|---|---|---|
| Alloy | Nd | Dy | B | Nb | Al | Co | Cu | Fe |
| A | 29.0 | 1.0 | 1.0 | 0.2 | 0.1 | 1.0 | 0.1 | Bal. |
| B | 15.0 | 15.0 | 1.0 | 0.2 | 0.1 | 1.0 | 0.1 | Bal. |

The above mixed coarse powder was pulverized by a jet mill in a nitrogen gas atmosphere having an oxygen concentration of 10 ppm or less by volume to provide fine powder having an average diameter of 4.0 μm The fine powder was directly recovered in a mineral oil ("Idemitsu Super-Sol PA-30," available from Idemitsu Kosan CO., LTD.) in a nitrogen gas atmosphere without contact with the air. The resultant fine powder slurry was subjected to a wet compression molding under the conditions of a magnetic field intensity of 10 kOe and compression pressure of 1.0 ton/cm$^2$. The resultant green body was subjected to oil removal at 200° C. in a vacuum of $5\times10^{-1}$ Torr for 1 hour, sintered at each temperature between 1050° C. and 1100° C. at about $3\times10^{-5}$ Torr for 2 hours, and then cooled to room temperature.

Each of the resultant sintered bodies was heat-treated twice at 900° C. for 2 hours and at 500° C. for 1 hour in an inert gas atmosphere, and then cooled to room temperature to provide an R—T—B sintered permanent magnet. As a result of measuring their magnetic properties at 20° C., the results shown in FIG. 1 were obtained. As is clear from FIG. 1, preferred magnetic properties for permanent magnets were obtained at sintering temperatures of 1070–1110° C. Particularly the sintering temperature of 1090° C. provided Br of 13.8 kG, iHc of 18 kOe, and $(BH)_{max}$ of 45.9 MGOe. Also, the sintering temperature of 1100° C. provided Br of 13.8 kG, iHc of 17.9 kOe, and $(BH)_{max}$ of 45.7 MGOe, Br and $(BH)_{max}$ being high.

Analysis of a typical sintered magnet among the above sintered magnets with respect to composition indicated that the main components were 27.3 weight % of Nd, 2.7 weight % of Dy, 1.0 weight % of B, 0.2 weight % of Nb, 0.1 weight % of Al, 1.0 weight % of Co, and 0.1 weight % of Cu, the balance being substantially Fe, and that the impurities were 0.17 weight % of O, 0.05 weight % of N, and 0.07 weight % of C.

A typical sintered magnet among the above sintered magnets was observed with respect to a cross section structure in the same manner as in EXAMPLE 7 below, to determine the concentration of a heavy rare earth element (Dy) not only in main-phase crystal grain particles ($R_2T_{14}B$) substantially in center portions but also in a crystal grain boundary phase. As a result, it was found that the $R_2T_{14}B$-type, main-phase crystal grain particles were constituted by first $R_2T_{14}B$-type, main-phase crystal grain particles having a higher concentration of a heavy rare earth element (Dy) than that of the crystal grain boundary phase, second $R_2T_{14}B$-type, main-phase crystal grain particles having a lower concentration of a heavy rare earth element (Dy) than that of the crystal grain boundary phase, and third $R_2T_{14}B$-type, main-phase crystal grain particles having substantially the same concentration of a heavy rare earth element (Dy) as that of the crystal grain boundary phase.

COMPARATIVE EXAMPLE 1

Coarse pulverization was carried out in the same manner as in EXAMPLE 1 except for using a cast alloy C having a main component composition shown in Table2. Analysis of this coarse powder with respect to composition indicated that the main components were 27.3 weight % of Nd, 2.7 weight % of Dy, 1.0 weight % of B, 0.2 weight % of Nb, 0.1 weight % of Al, 1.0 weight % of Co, and 0.1 weight % of Cu, the balance being substantially Fe, and that the impurities were 0.13 weight % of O, 0.008 weight % of N, and 0.02 weight % of C.

TABLE 2

| | Composition (weight %) | | | | | | | |
|---|---|---|---|---|---|---|---|---|
| Alloy | Nd | Dy | B | Nb | Al | Co | Cu | Fe |
| C | 27.3 | 2.7 | 1.0 | 0.2 | 0.1 | 1.0 | 0.1 | Bal. |

This coarse powder was subjected to fine pulverization to an average diameter of 4.1 $\mu$m, forming into a slurry, molding in a magnetic field, oil removal, sintering and heat treatment in the same manner as in EXAMPLE 1, thereby providing a sintered permanent magnet of Comparative Example by a single method. Analysis of this sintered permanent magnet with respect to composition indicated that the main components were 27.3 weight % of Nd, 2.7 weight % of Dy, 1.0 weight % of B, 0.2 weight % of Nb, 0.1 weight % of Al, 1.0 weight % of Co, and 0.1 weight % of Cu, the balance being substantially Fe, and that the impurities were 0.15 weight % of O, 0.04 weight % of N, and 0.06 weight % of C.

The measurement results of magnetic properties at 20° C. are shown in FIG. 1. It is clear from FIG. 1 that though this sintered permanent magnet had as high iHc as about 19 kOe, it had Br of 13.3 kG or less and $(BH_{max})$, of 42.5 MGOe or less, smaller than those in EXAMPLE 1. Also, main-phase crystal grain particles having a higher concentration of a heavy rare earth element Dy than that of the crystal grain boundary phase were not observed in a cross section structure of the sintered magnet of this Comparative Example.

EXAMPLE 2

Coarse pulverization was carried out in the same manner as in EXAMPLE 1 except for using cast alloys D and E having main component compositions shown in Table 3. 94 kg of coarse powder of the alloy D and 6 kg of coarse powder of the alloy E were charged into a V-type blender to provide 100 kg of mixed coarse powder. As a result of analysis of this mixed coarse powder with respect to composition, the main components of this mixed coarse powder were 22A weight % of Nd, 8.9 weight % of Pr, 1.2 weight % of Dy, 1.0 weight % of B, 0.1 weight % of Al, 0.15 weight % of Ga, the balance being substantially Fe, and that the impurities were 0.14 weight % of O, 0.01 weight % of N, and 0.01 weight % of C.

TABLE 3

| | Composition (weight %) | | | | | | |
|---|---|---|---|---|---|---|---|
| Alloy | Nd | Pr | Dy | B | Al | Ga | Fe |
| D | 23.2 | 9.3 | — | 1.0 | 0.1 | 0.15 | Bal. |
| E | 8.9 | 3.6 | 20.0 | 1.0 | 0.1 | 0.15 | Bal. |

The above mixed coarse powder was pulverized by a jet mill in a nitrogen gas atmosphere having an oxygen concentration of 500 ppm or less by volume to provide fine powder having an average diameter of 4.1 $\mu$m. The fine powder was subjected to a dry compression molding under the conditions of a magnetic field intensity of 10 kOe and compression pressure of 1.5 ton/cm$^2$. The resultant green body was sintered at each temperature between 1040° C. and 1110° C. at about $3\times10^{-5}$ Torr for 2 hours, and then cooled to room temperature.

Each of the resultant sintered bodies was heat-treated twice at 900° C. for 3 hours and at 550° C. for 1 hour in an inert gas atmosphere, and then cooled to room temperature to provide an R—T—B sintered permanent magnet. As a result of measuring their magnetic properties at 20° C., the results shown in FIG. 2 were obtained. As is clear from FIG. 2, preferred magnetic properties for permanent magnets were obtained at sintering temperatures of 1050–1100° C. Particularly the sintering temperature of 1070° C. provided Br of 13.4 kG, iHc of 16.3 kOe, and $(BH)_{max}$ of 43.2 MGOe. Also, the sintering temperature of 1080° C. provided Br of 13.4 kG, iHc of 15.1 kOe, and $(BH)_{max}$ of 43.3 MGOe, Br and $(BH)_{max}$ being high.

Analysis of a typical sintered magnet among the above sintered magnets with respect to composition indicated that the main components were 22.4 weight % of Nd, 8.9 weight % of Pr, 1.2 weight % of Dy, 1.0 weight % of B, 0.1 weight % of Al, and 0.15 weight % of Ga, the balance being substantially Fe, and that the impurities were 0.45 weight % of O, 0.02 weight % of N, and 0.07 weight % of C.

A typical sintered magnet among the above sintered magnets was observed with respect to a cross section structure in the same manner as in EXAMPLE 7 below, to determine the concentration of a heavy rare earth element (Dy) not only in main-phase crystal grain particles ($R_2T_{14}B$) substantially in center portions but also in a crystal grain boundary phase. As a result, it was found that the $R_2T_{14}B$-type, main-phase crystal grain particles were constituted by first $R_2T_{14}B$-type, main-phase crystal grain particles having a higher concentration of a heavy rare earth element (Dy) than that of the crystal grain boundary phase, second $R_2T_{14}B$-type, main-phase crystal grain particles having a lower concentration of a heavy rare earth element (Dy) than that of the crystal grain boundary phase, and third $R_2T_{14}B$-type, main-phase crystal grain particles having substantially the same concentration of a heavy rare earth element (Dy) as that of the crystal grain boundary phase.

COMPARATIVE EXAMPLE 2

Coarse pulverization was carried out in the same manner as in EXAMPLE 1 except for using a cast alloy F having a main component composition shown in Table 4. Analysis of this coarse powder with respect to composition indicated that the main components were 22.4 weight % of Nd, 8.9 weight % of Pr, 1.2 weight % of Dy, 1.0 weight % of B, 0.1 weight % of Al, and 0.15 weight % of Ga, the balance being substantially Fe, and that the impurities were 0.14 weight % of O, 0.01 weight % of N, and 0.02 weight % of C.

TABLE 4

| | Composition (weight %) | | | | | | |
|---|---|---|---|---|---|---|---|
| Alloy | Nd | Pr | Dy | B | Al | Ga | Fe |
| F | 22.4 | 8.9 | 1.2 | 1.0 | 0.1 | 0.15 | Bal. |

This coarse powder was subjected to fine pulverization to an average diameter of 4.0 $\mu$m, molding in a magnetic field, sintering and heat treatment in the same manner as in EXAMPLE 2, thereby providing a sintered permanent magnet of Comparative Example by a single method. Analysis of this sintered permanent magnet with respect to composition indicated that the main components were 22.4 weight % of Nd, 8.9 weight % of Pr, 1.2 weight % of Dy, 1.0 weight % of B, 0.1 weight % of Al, and 0.15 weight % of Ga, the balance being substantially Fe, and that the impurities were 0.43 weight % of O, 0.03 weight % of N, and 0.06 weight % of C.

Figure 2:
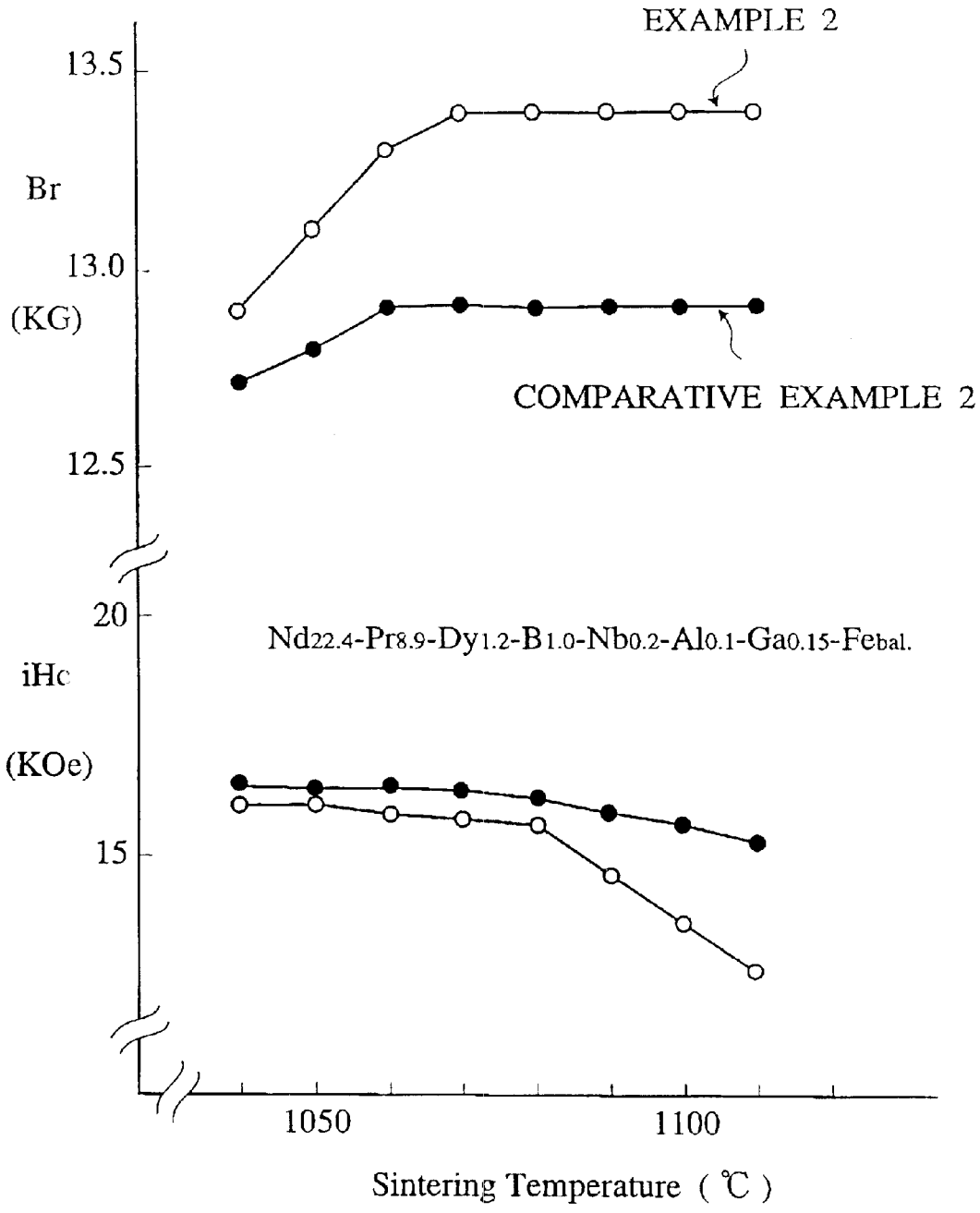
FIG. 2 is a graph showing the relation between a sintering temperature and magnetic properties (Br, iHc) in the R—T—B sintered permanent magnets of EXAMPLE 2 and COMPARATIVE EXAMPLE 2.

The measurement results of magnetic properties at 20° C. are shown in FIG. 2. It is clear from FIG. 2 that though this sintered permanent magnet had slightly higher iHc than that in EXAMPLE 2, it had as low Br as 12.9 kG or less and as low $(BH)_{max}$ as 40.1 MGOe or less. Also, main-phase crystal grain particles having a higher concentration of a heavy rare earth element (Dy) than that of the crystal grain boundary phase were not observed in a cross section structure of the sintered magnet of this Comparative Example.

EXAMPLE 3

Coarse pulverization was carried out in the same manner as in EXAMPLE 1 except for using cast alloys G and H having main component compositions shown in Table 5. 81.8 kg of coarse powder of the alloy G and 18.2 kg of coarse powder of the alloy H were charged into a V-type blender to provide 100 kg of mixed coarse powder. As a result of analysis of this mixed coarse powder with respect to composition, the main components of this mixed coarse powder were 19.14 weight % of Nd, 5.34 weight % of Pr, 6.00 weight % of Dy, 0.97 weight % of B, 0.29 weight % of Nb, 0.10 weight % of Al, 2.00 weight % of Co, 0.08 weight % of Ga, and 0.10 weight % of Cu, the balance being substantially Fe, and that the impurities were 0.14 weight % of O, 0.01 weight N of N, and 0.02 weight % of C.

TABLE 5

| | Composition (weight %) | | | | | | | | | |
|---|---|---|---|---|---|---|---|---|---|---|
| Alloy | Nd | Pr | Dy | B | Nb | Al | Co | Ga | Cu | Fe |
| G | 22.29 | 6.21 | 2.00 | 0.97 | 0.35 | 0.10 | 2.00 | 0.08 | 0.10 | Bal. |
| H | 5.03 | 1.47 | 24.00 | 0.97 | — | 0.10 | 2.00 | 0.08 | 0.10 | Bal. |

This mixed coarse powder was subjected to fine pulverization to an average diameter of 4.2 $\mu$m, forming to slurry and compression-molding in a magnetic field in the same manner as in EXAMPLE 1. The resultant green body was subjected to oil removal at 200° C. in a vacuum of about $5\times10^{-1}$ Torr for 1 hour, sintered at each temperature between 1060° C. and 1130° C. at about $2\times10^{-5}$ Torr for 2 hours, and then cooled to room temperature.

Each of the resultant sintered bodies was heat-treated twice at 900° C. for 2 hours and at 500° C. for 1 hour in an inert gas atmosphere, and then cooled to room temperature to provide an R—T—B sintered permanent magnet. As a result of measuring their magnetic properties at 20° C., the results shown in FIG. 3 were obtained. As is clear from FIG. 3, preferred magnetic properties for permanent magnets were obtained at sintering temperatures of 1070–1120° C. Particularly the sintering temperature of 1100° C. provided Br of 12.7 kG, iHc of 25.5 kOe, and $(BH)_{max}$ of 38.8 MGOe. Also, the sintering temperature of 1110° C. provided Br of 12.7 kG, iHc of 25.3 kOe, and $(BH)_{max}$ of 38.6 MGOe, Br and $(BH)_{max}$ being high.

Analysis of a typical sintered magnet among the above sintered magnets with respect to composition indicated that the main components were 19.14 weight % of Nd, 5.34 weight % of Pr, 6.00 weight % of Dy, 0.97 weight % of B, 0.29 weight % of Nb, 0.10 weight % of Al, 2.00 weight % of Co, 0.08 weight % of Ga, and 0.10 weight % of Cu, the balance being substantially Fe, and that the impurities were 0.16 weight % of 0. 0.05 weight % of N, and 0.07 weight % of C.

With respect to cross section structures of the above permanent magnets produced at sintering temperatures of 1100° C. and 1110° C., respectively, the concentration of a heavy rare earth element (Dy) was measured in main-phase crystal grain particles ($R_2T_{14}B$) substantially in center portions and a crystal grain boundary phase in the same manner as in EXAMPLE 7 below. As a result, it was found that the $R_2T_{14}B$-type, main-phase crystal grain particles were constituted by fist $R_2T_{14}B$-type, main-phase crystal grain particles having a higher concentration of a heavy rare earth element (Dy) than that of the crystal grain boundary phase, second $R_2T_{14}B$-type, main-phase crystal grain particles having a lower concentration of a heavy rare earth element (Dy) than that of the crystal grain boundary phase, and third $R_2T_{14}B$-type, main-phase crystal grain particles having substantially the same concentration of a heavy rare earth element (Dy) as that of the crystal grain boundary phase.

COMPARATIVE EXAMPLE 3

Coarse pulverization was cared out in the same manner as in EXAMPLE 1 except for using a cast alloy I having a main component composition shown in Table 6. Analysis of this coarse powder with respect to composition indicated that the main components were 19.14 weight % of Nd, 5.34 weight % of Pr, 6.00 weight % of Dy, 0.97 weight % of B, 0.29 weight % of Nb, 0.10 weight % of Al, 2.00 weight % of Co, 0.08 weight % of Ga, and 0.10 weight % of Cu, the balance being substantially Fe, and that the impurities were 0.12 weight % of O, 0.01 weight % of N, and 0.01 weight % of C.

TABLE 6

| | Composition (weight %) | | | | | | | | | |
|---|---|---|---|---|---|---|---|---|---|---|
| Alloy | Nd | Pr | Dy | B | Nb | Al | Co | Ga | Cu | Fe |
| I | 19.14 | 5.34 | 6.00 | 0.97 | 0.29 | 0.10 | 2.00 | 0.08 | 0.10 | Bal. |

This coarse powder was subjected to fine pulverization to an average diameter of 4.2 μm, forming to slurry and molding in a magnetic field in the same manner as in EXAMPLE 1. The resultant green body was subjected to oil removal, sintering and heat treatment under the same conditions as in EXAMPLE 3 to provide a sintered permanent magnet of Comparative Example by a single method. Analysis of this magnet indicated that the main components with respect to composition were 19.14 weight % of Nd, 5.34 weight % of Pr, 6.00 weight % of Dy, 0.97 weight % of B, 0.29 weight % of Nb, 0.10 weight % of Al, 2.00 weight % of Co, 0.08 weight % of Ga, and 0.10 weight % of Cu, the balance being substantially Fe, and that the impurities were 0.14 weight % of O, 0.04 weight % of N, and 0.06 weight % of C.

Figure 3:
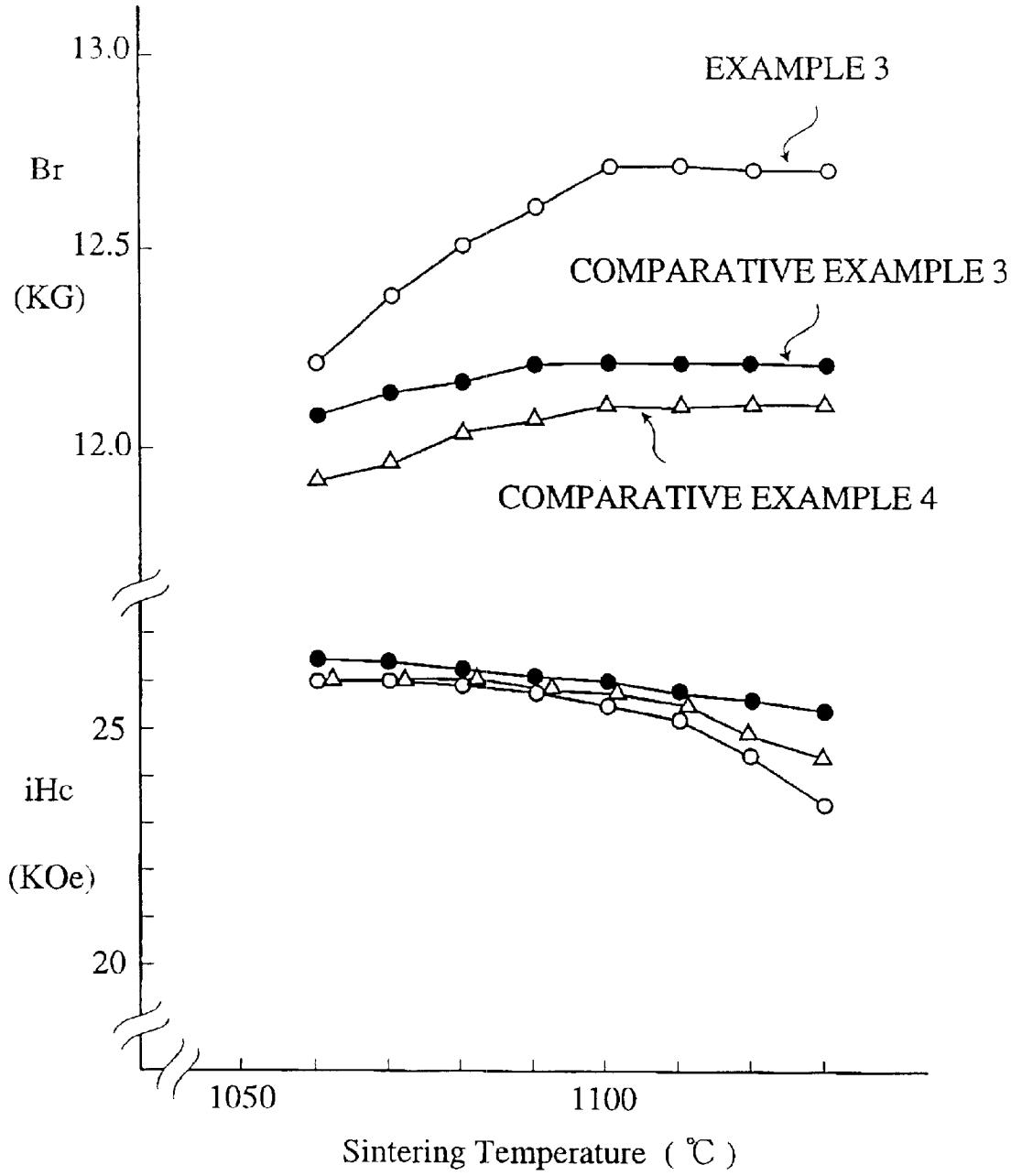
FIG. 3 is a graph showing the relation between a sintering temperature and magnetic properties (Br, iHc) in the R—T—B sintered permanent magnets of EXAMPLE 3 and COMPARATIVE EXAMPLES 3 and 4.
Figure 4A:
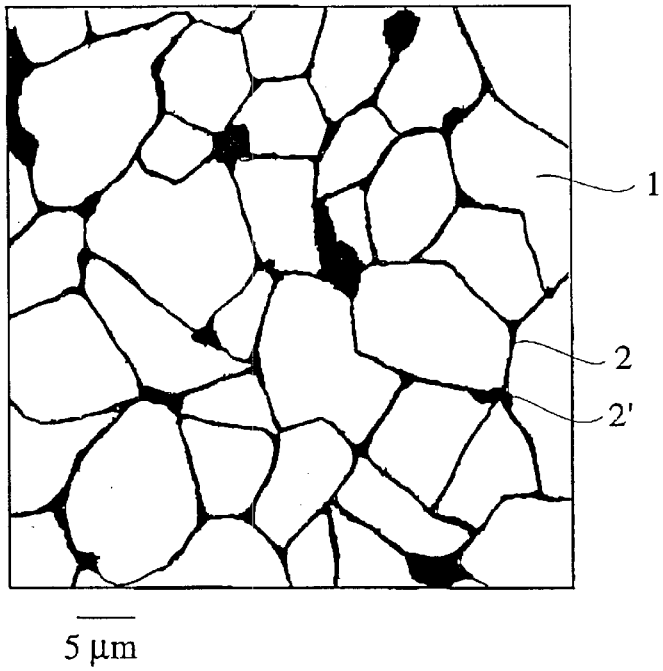
FIG. 4(*a*) is a schematic view showing the crystal structure of the R—T—B sintered permanent magnet of EXAMPLE 7.
Figure 4B:
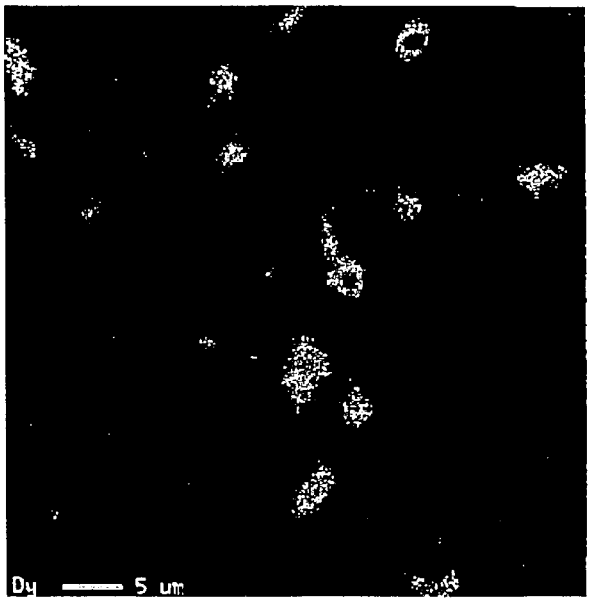
Figure 4C:
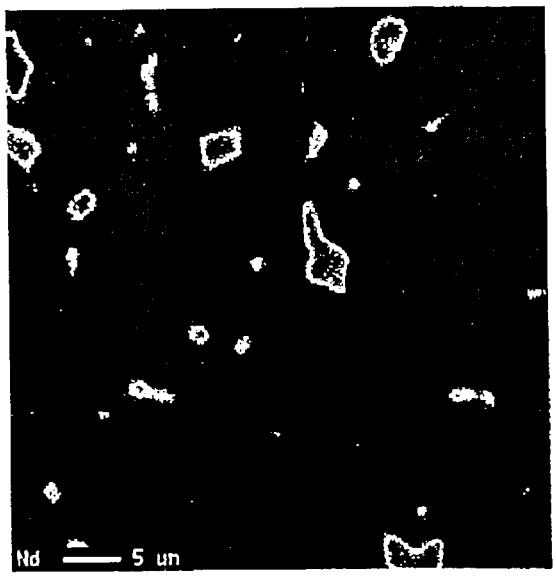
Figure 4D:
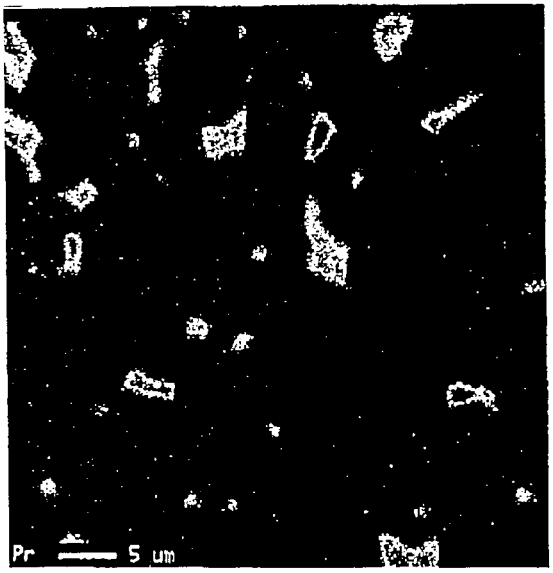

The measurement results of magnetic properties at 20° C. are shown in FIG. 3. It is clear from FIG. 3 that though this sintered permanent magnet had as high iHc as about 25 kOe, it had Br of 12.2 kG or less and $(BH)_{max}$ of 35.7 MGOe or less, smaller than those in EXAMPLE 3. Also, main-phase crystal grain particles having a higher concentration of a heavy rare earth element (Dy) than that of the crystal grain boundary phase were not observed in a cross section structure of the sintered magnet of this Comparative Example.

COMPARATIVE EXAMPLE 4

Coarse pulverization was carried out in the same manner as in EXAMPLE 1 except for using cast alloys J and K having main component compositions shown in Table 7. 81.8 kg of coarse powder of the alloy J and 18.2 kg of coarse powder of the alloy K were charged into a V-type blender to provide 100 kg of mixed coarse powder. As a result of analysis of this mixed coarse powder with respect to composition, the main components of this mixed coarse powder were 19.14 weight % of Nd, 5.34 weight % of Pr, 6.00 weight % of Dy, 0.97 weight % of B, 0.65 weight % of Nb, 0.10 weight % of Al, 2.00 weight % of Co, 0.08 weight % of Ga, and 0.10 weight % of Cu, the balance being substantially Fe, and that the impurities were 0.15 weight % of O, 0.02 weight % of N, and 0.02 weight % of C.

TABLE 7

| | Composition (weight %) | | | | | | | | | |
|---|---|---|---|---|---|---|---|---|---|---|
| Alloy | Nd | Pr | Dy | B | Nb | Al | Co | Ga | Cu | Fe |
| J | 22.29 | 6.21 | 2.00 | 0.97 | 0.80 | 0.10 | 2.00 | 0.08 | 0.10 | Bal. |
| K | 5.03 | 1.47 | 24.00 | 0.97 | — | 0.10 | 2.00 | 0.08 | 0.10 | Bal. |

This coarse powder was subjected to fine pulverization to an average diameter of 4.1 μm, forming to slurry and molding in a magnetic field in the same manner as in EXAMPLE 1. The resultant green body was subjected to oil removal at 200° C. in a vacuum of about $5\times10^{-1}$ Torr for 1 hour, sintered at each temperature between 1060° C. and 1130° C. at about $2\times10^{-5}$ Torr for 2 hours, and then cooled to room temperature.

Each of the resultant sintered bodies was heat-treated twice at 900° C. for 2 hours and at 500° C. for 1 hour in an inert gas atmosphere, and then cooled to room temperature to provide a sintered permanent magnet of Comparative Example by a blend method. As a result of measuring their magnetic properties at 20° C., the results shown in FIG. 3 were obtained. As is clear from FIG. 3, the sintering temperature of 1100° C. provided Br of 12.1 kG, iHc of 25.4 kOe, and $(BH)_{max}$ of 35.1 MGOe. Also, the sintering temperature of 1110° C. provided Br of 12.1 kG, iHc of 25.2 kOe, and $(BH)_{max}$ of 35.0 MGOe, Br and $(BH)_{max}$ being low.

Analysis of the sintered magnet of this Comparative Example with respect to composition indicated that the main components were 19.14 weight % of Nd, 5.34 weight % of Pr, 6.00 weight % of Dy, 0.97 weight % of B, 0.65 weight % of Nb, 0.10 weight % of Al, 2.00 weight % of Co, 0.08 weight % of Ga, and 0.10 weight % of Cu, the balance being substantially Fe, and that the impurities were 0.17 weight % of O, 0.06 weight % of N, and 0.06 weight % of C. Why the sintered magnet of this Comparative Example has low Br and $(BH)_{max}$ appears to be due to the fact that normal growth of main-phase crystal grain particles during sintering is hindered by as high a Nb content as 0.65 weight %.

EXAMPLE 4

Coarse pulverization was carried out in the same manner as in EXAMPLE 1 except for using cast alloys L and M having main component compositions shown in Table 8. 90.0 kg of coarse powder of the alloy L and 10.0 kg of coarse powder of the alloy M were charged into a V-type blender to provide 100 kg of mixed coarse powder. As a result of analysis of this mixed coarse powder with respect to composition, the main components of this mixed coarse powder were 22.83 weight % of Nd, 6.37 weight % of Pr, 1.30 weight % of Dy, 1.05 weight % of B, 0.13 weight % of Mo, and 0.10 weight % of Al, the balance being substantially Fe, and that the impurities were 0.15 weight % of O, 0.01 weight % of N, and 0.02 weight % of C.

TABLE 8

| Alloy | Composition (weight %) | | | | | | |
|---|---|---|---|---|---|---|---|
| | Nd | Pr | Dy | B | Mo | Al | Fe |
| L | 23.85 | 6.65 | — | 1.05 | 0.15 | 0.10 | Bal. |
| M | 13.68 | 3.82 | 13.00 | 1.05 | — | 0.10 | Bal. |

This mixed coarse powder was subjected to fine pulverization to an average diameter of 4.0 $\mu$m, forming to slurry and molding in a magnetic field in the same manner as in EXAMPLE 1. The resultant green body was subjected to oil removal at 200° C. in a vacuum of about $5\times10^{-4}$ Torr for 1 hour, sintered at each temperature between 1050° C. and 1100° C. in vacuum of about $2\times10^{-5}$ Torr for 2 hours, and then cooled to room temperature.

Each of the resultant sintered bodies was heat-treated twice at 900° C. for 2 hours and at 550° C. for 1 hour in an inert gas atmosphere, and then cooled to room temperature to provide an R—T—B sintered permanent magnet. As a result of measuring their magnetic properties at 20° C., it was found that preferred magnetic properties for permanent magnets were obtained at sintering temperatures of 1060–1090° C. Particularly the sintering temperature of 1070° C. provided Br of 13.9 kG, iHc of 15.5 kOe, and $(BH)_{max}$ of 46.5 MGOe. Also, the sintering temperature of 1080° C. provided Br of 14.0 kG, iHc of 15.3 kOe, and $(BH)_{max}$ of 47.2 MGOe, Br and $(BH)_{max}$ being high.

Analysis of a typical sintered magnet among the above sintered magnets with respect to composition indicated that the main components were 22.83 weight % of Nd, 6.37 weight % of Pr, 1.30 weight % of Dy, 1.05 weight % of B, 0.13 weight % of Mo, and 0.10 weight % of Al, the balance being substantially Fe, and that the impurities were 0.18 weight % of O, 0.06 weight % of N, and 0.08 weight % of C.

With respect to cross section structures of the above permanent magnets produced at sintering temperatures of 1070° C. and 1080° C., respectively, the concentration of a heavy rare earth element (Dy) was measured in main-phase crystal grain particles ($R_2T_{14}B$) substantially in center portions and a crystal grain boundary phase in the same manner as in EXAMPLE 7 below. As a result, it was found that the $R_2T_{14}B$-type, main-phase crystal gram particles were constituted by first $R_2T_{14}B$-type, main-phase crystal grain particles having a higher concentration of a heavy rare earth element (Dy) than that of the crystal grain boundary phase, second $R_2T_{14}B$-type, main-phase crystal grain particles having a lower concentration of a heavy rare earth element (Dy) than that of the crystal gain boundary phase, and third $R_2T_{14}B$-type, main-phase crystal grain particles having substantially the same concentration of a heavy rare earth element (Dy) as that of the crystal grain boundary phase.

EXAMPLE 5

Coarse pulverization was carried out in the same manner as in EXAMPLE 1 except for using cast alloys N and 0 having main component compositions shown in Table 9. 80.0 kg of coarse powder of the alloy N and 20.0 kg of coarse powder of the alloy O were charged into a V-type blender to provide 100 kg of mixed coarse powder. As a result of analysis of this mixed coarse powder with respect to composition, the main components of this mixed coarse powder were 26.2 weight % of Nd, 5.8 weight % of Dy, 0.95 weight % of B, 0.20 weight % of Nb, 0.1 weight % of Al, 2.5 weight % of Co, 0.15 weight % of Cu, and 0.15 weight % of Ga, the balance being substantially Fe, and that the impurities were 0.15 weight % of O, 0.02 weight % of N, and 0.02 weight % of C.

TABLE 9

| Alloy | Composition (weight %) | | | | | | | | |
|---|---|---|---|---|---|---|---|---|---|
| | Nd | Dy | B | Nb | Al | Co | Cu | Ga | Fe |
| N | 29.0 | 3.0 | 0.95 | — | 0.10 | 2.50 | 0.15 | 0.15 | Bal. |
| O | 15.0 | 17.0 | 0.95 | 1.00 | 0.10 | 2.50 | 0.15 | 0.15 | Bal. |

The above mixed coarse powder was pulverized by a jet mill in a nitrogen gas atmosphere having an oxygen concentration of 500 ppm or less by volume to provide fine powder having an average diameter of 4.2 $\mu$m. The fine powder was subjected to a dry compression molding under the conditions of a magnetic field intensity of 10 kOe and compression pressure of 1.5 ton/cm$^2$. The resultant green body was sintered at each temperature between 1040° C. and 1110° C. at about $3\times10^{-5}$ Torr for 2 hours, and then cooled to room temperature.

Each of the resultant sintered bodies was heat-treated twice at 900° C. for 3 hours and at 480° C. for 1 hour in an inert gas atmosphere, and then cooled to room temperature to provide an R—T—B sintered permanent magnet. As a result of measuring their magnetic properties at 20° C., it was found that preferred magnetic properties for permanent magnets were obtained at sintering temperatures of 1050–1090° C. Particularly the sintering temperature of 1070° C. provided Br of 12.5 kG, iHc of 24.5 kOe, and $(BH)_{max}$ of 37.5 MGOe. Also, the sintering temperature of 1080° C. provided Br of 12.5 kG, iHc of 24.2 kOe, and $(BH)_{max}$ of 37.4 MGOe, Br and $(BH)_{max}$ being high. Analysis of the permanent magnet indicated that its main components were 26.2 weight % of Nd, 5.8 weight % of Dy, 0.95 weight % of B, 0.20 weight % of Nb, 0.1 weight % of Al, 2.5 weight % of Co, 0.15 weight % of Cu, and 0.15 weight % of Ga, the balance being substantially Fe, and that its inevitable impurities were 0.38 weight % of O, 0.03 weight % of N, and 0.05 weight % of C.

With respect to cross section structures of the above permanent magnets produced at sintering temperatures of 1070° C. and 1080° C., respectively, the concentration of a heavy rare earth element (Dy) was measured in main-phase crystal grain particles ($R_2T_{14}B$) substantially in center portions and a crystal grain boundary phase in the same manner as in EXAMPLE 7 below. As a result, it was found that the $R_2T_{14}B4$type, main-phase crystal grain particles were constituted by first $R_2T_{14}B$-type, main-phase crystal grain particles having a higher concentration of a heavy rare earth element (Dy) than that of the crystal grain boundary phase, second $R_2T_{14}B$-type, main-phase crystal grain particles having a lower concentration of a heavy rare earth element (Dy) than that of the crystal grain boundary phase, and third $R_2T_{14}B$-type, main-phase crystal grain particles having substantially the same concentration of a heavy rare earth element (Dy) as that of the crystal grain boundary phase.

EXAMPLE 6

Coarse pulverization was carried out in the same manner as in EXAMPLE 1 except for using cast alloys P and Q having main component compositions shown in Table 10. 90.0 kg of coarse powder of the alloy P and 10.0 kg of coarse powder of the alloy Q were charged into a V-type blender to provide 100 kg of mixed coarse powder. As a result of analysis of this mixed coarse powder with respect to composition, it was found that the main components of this mixed coarse powder were 20.6 weight % of Nd, 8.8 weight % of Pr, 2.6 weight % of Dy, 1.06 weight % of B, 0.18 weight % of W, 0.05 weight % of Al, and 0.17 weight % of Ga, the balance being substantially Fe, and that the impurities were 0.15 weight % of O, 0.01 weight % of N, and 0.01 weight % of C.

TABLE 10

| | Composition (weight %) | | | | | | | |
|---|---|---|---|---|---|---|---|---|
| Alloy | Nd | Pr | Dy | B | W | Al | Ga | Fe |
| P | 21.70 | 9.30 | 1.00 | 1.06 | 0.20 | 0.05 | 0.17 | Bal. |
| Q | 10.50 | 4.50 | 17.00 | 1.06 | — | 0.05 | 0.17 | Bal. |

The above mixed coarse powder was pulverized by a jet mill in a nitrogen gas atmosphere having an oxygen concentration of 500 ppm or less by volume to provide fine powder having an average diameter of 4.2 $\mu$m. The fine powder was subjected to a dry compression molding under the conditions of a magnetic field intensity of 10 kOe and compression pressure of 1.5 ton/cm$^2$. The resultant green body was sintered at each temperature between 1040° C. and 1100° C. at about $3\times10^{-5}$ Torr for 2 hours, and then cooled to room temperature.

Each of the resultant sintered bodies was heat-treated twice at 900° C. for 3 hours and at 550° C. for 1 hour in an inert gas atmosphere, and then cooled to room temperature to provide an R—T—B sintered permanent magnet. As a result of measuring their magnetic properties at 20° C., it was found that preferred magnetic properties for permanent magnets were obtained at sintering temperatures of 1050–1090° C. Particularly the sintering temperature of 1070° C. provided Br of 13.2 kG, iHc of 195 kOe, and $(BH)_{max}$ of 41.8 MGOe. Also, the sintering temperature of 1080° C. provided Br of 13.2 kG, iHc of 19.3 kOe, and $(BH)_{max}$ of 41.7 MGOe, Br and $(BH)_{max}$ being high.

Analysis of a typical permanent magnet among the above permanent magnets with respect to composition indicated that its main components were 20.6 weight % of Nd, 8.8 weight % of Pr, 2.6 weight % of Dy, 1.06 weight % of B, 0.18 weight % of W, 0.05 weight % of Al, and 0.17 weight % of Ga, the balance being substantially Fe, and that the impurities were 0.50 weight % of O, 0.02 weight % of N, and 0.06 weight % of C.

With respect to cross section structures of the above permanent magnets produced at sintering temperatures of 1070° C. and 1080° C., respectively, the concentration of a heavy rare earth element (Dy) was measured in main-phase crystal grain particles ($R_2T_{14}B$) substantially in center portions and a crystal gain boundary phase in the same manner as in EXAMPLE 7 below. As a result, it was found that the $R_2T_{14}B$-type, main-phase crystal grain particles were constituted by first $R_2T_{14}B$-type, main-phase crystal grain particles having a higher concentration of a heavy rare earth element (Dy) than that of the crystal grain boundary phase, second $R_2T_{14}B$-type, main-phase crystal grain particles having a lower concentration of a heavy rare earth element (Dy) than that of the crystal grain boundary phase, and third $R_2T_{14}B$-type, main-phase crystal grain particles having substantially the same concentration of a heavy rare earth element (Dy) as that of the crystal grain boundary phase.

EXAMPLE 7

Coarse pulverization was carried out in the same manner as in EXAMPLE 1 except for using cast alloys R and S having main component compositions shown in Table 11. 90.0 kg of coarse powder of the alloy R and 10.0 kg of coarse powder of the alloy S were charged into a V-type blender to provide 100 kg of mixed coarse powder. As a result of analysis of this mixed coarse powder with respect to composition, it was found that the main components of this mixed coarse powder were 21.38 weight % of Nd, 7.12 weight % of Pt, 1.50 weight % of Dy, 1.03 weight % of B, 0.08 weight % of Al, 2.00 weight % of Co, 0.08 weight % of Ga, and 0.1 weight % of Cu, the balance being substantially Fe, and that the impurities were 0.14 weight % of O, 0.02 weight % of N, and 0.02 weight % of C.

TABLE 11

| | Composition (weight %) | | | | | | | | |
|---|---|---|---|---|---|---|---|---|---|
| Alloy | Nd | Pr | Dy | B | Al | Co | Ga | Cu | Fe |
| R | 22.50 | 7.50 | — | 1.03 | 0.08 | 2.00 | 0.08 | 0.10 | Bal. |
| S | 11.25 | 3.75 | 15.00 | 1.03 | 0.08 | 2.00 | 0.08 | 0.10 | Bal. |

The above mixed coarse powder was pulverized by a jet mill in a nitrogen gas atmosphere having an oxygen concentration of 10 ppm or less by volume to provide fine powder having an average diameter of 4.2 $\mu$m The fine powder was directly recovered in a mineral oil ("Idemitsu Super-Sol PA-30," available from Idemitsu Kosan CO., LTD.) in a nitrogen gas atmosphere without contact with the air. The resultant fine powder slurry was subjected to compression molding under the conditions of a magnetic field intensity of 10 kOe and compression pressure of 1.0 ton/cm$^2$. The resultant green body was subjected to oil removal at 200° C. in a vacuum of $5\times10^{-1}$ Torr for 1 hour, sintered at each temperature between 1040° C. and 1100° C. at about $3\times10^{-5}$ Torr for 2 hours, and then cooled to room temperature.

Each of the resultant sintered bodies was heat-treated twice at 900° C. for 2 hours and at 480° C. for 1 hour in an inert gas atmosphere, and then cooled to room temperature to provide an R—T—B sintered permanent magnet. As a result of measuring their magnetic properties at 20° C., it was found that preferred magnetic properties for permanent magnets were obtained at sintering temperatures of 1060–1090° C. Particularly the sintering temperature of 1070° C. provided Br of 13.9 kG, iHc of 15 kOe, and $(BH)_{max}$ of 46.5 MGOe. Also, the sintering temperature of 1080° C. provided Br of 14.0 kG, iHc of 14.8 kOe, and $(BH)_{max}$ of 47.2 MGOe, Br and $(BH)_{max}$ being high.

Analysis of a typical permanent magnet among the above permanent magnets indicated that its main components were 21.38 weight % of Nd, 7.12 weight % of Pr, 1.50 weight % of Dy, 1.03 weight % of B, 0.08 weight % of Al, 2.00 weight % of Co, 0.08 weight % of Ga, and 0.1 weight % of Cu, the balance being substantially Fe, and that the impurities were 0.16 weight % of O, 0.06 weight % of N, and 0.06 weight % of C.

A cross section structure of a typical sintered magnet among the above sintered magnets was analyzed by an electron probe micro-analyzer (EPMA, "JXA-8800," available from JEOL) under the conditions below.

Acceleration voltage: 15 kV,

Current applied to sample: about $4\times10^{-8}$ A,

X-ray irradiation time per one analysis point (measurement time): 10 msec.,

Number of analysis points: 400 in each of X and Y directions,

Interval between adjacent analysis points in X and Y directions: 0.12 μm, and

Area of analysis: 0.12 μm×400 points=rectangular range of 48 μm.

With irradiating beams focused to a minimum spot under the above conditions, the concentration distributions of Dy, Nd and Pr were measured. A spectroscopic crystal used for the analysis of Dy, Nd and Pr was high-sensitivity lithium fluoride (LiF). The crystal structure of the R—T—B sintered permanent magnet of the present invention is schematically shown in FIG. 4(*a*).

The crystal structure comprises $R_2T_{14}B$-type, main-phase crystal grain particles 1 and a crystal grain boundary phase 2, and triple points 2' of the crystal grain boundary phase 2 are indicated by black regions. In the crystal structure of FIG. 4(*a*), a concentration distribution of Dy is shown in FIG. 4(*b*), a concentration distribution of Nd is shown in FIG. 4(*c*), and a concentration distribution of Pr is shown in FIG. 4(*d*). As is clear from FIGS. 4(*b*)–(*d*), distributions of Nd, Dy and Pr in the crystal grain boundary phase were observed substantially only in their triple points, not because Nd, Dy and Pr were distributed only in triple points, but because their distributions are relatively scarce in extremely thin crystal grain boundary phase portions other than triple points.

In FIG. 4(*a*), the triple points of the crystal grain boundary phase are formed by an R (Nd, Dy, Pr)-rich phase. It was clear from FIGS. 4(*c*) and (*d*) that Nd and Pr existed substantially in the same portions. Also, it is clear from FIGS. 4(*b*)–(*d*) that though Dy exists substantially in the same portions of the crystal grain boundary phase as those of Nd and Pr, Dy tends to exist at high concentration even in core portions of the $R_2T_{14}B$-type, main-phase crystal grain particles inside from the crystal grain boundary by 1.0 μm or more.

It was found from these observation results that there were three patterns in a concentration distribution of Dy from the crystal grain boundary phase to center portions of the main-phase crystal grain particles. In the fist pattern, the concentration of Dy is higher in core portions of the main-phase crystal grain particles than in the crystal grain boundary phase. In the second pattern, the concentration of Dy is high in the crystal grain boundary phase and low in core portions of the main-phase crystal grain particles. In the third pattern, the concentration distribution of Dy is substantially uniform from the crystal grain boundary phase to core portions of the main-phase crystal grain particles. In FIG. 4(*b*), the number of the first main-phase crystal grain particles having a higher Dy concentration in their core portions than in the crystal grain boundary phase was 6, the number of the second main-phase crystal grain particles having a lower Dy concentration in their core portions than in the crystal grain boundary phase was 15, and the number of the third main-phase crystal grain particles having substantially the same Dy concentration in their core portions as in the crystal grain boundary phase was 19. Incidentally, in the evaluation of concentration distributions of Dy, Nd and Pr in FIGS. 4(*b*)–(*d*), influence of voids generated during the preparation of samples for microscopic observation was taken into consideration. It should be noted that FIGS. 4(*a*)–(*d*) illustrate only one example of the cross section structures, and that to determine the Dy concentration distribution, data obtained from photomicrographs of cross section structures taken in a lot of visual fields should be averaged. Thus, the R—T—B sintered permanent magnet of the present invention has a characteristic concentration distribution of Dy in the main-phase crystal grain particles and the crystal grain boundary phase.

Figure 5:
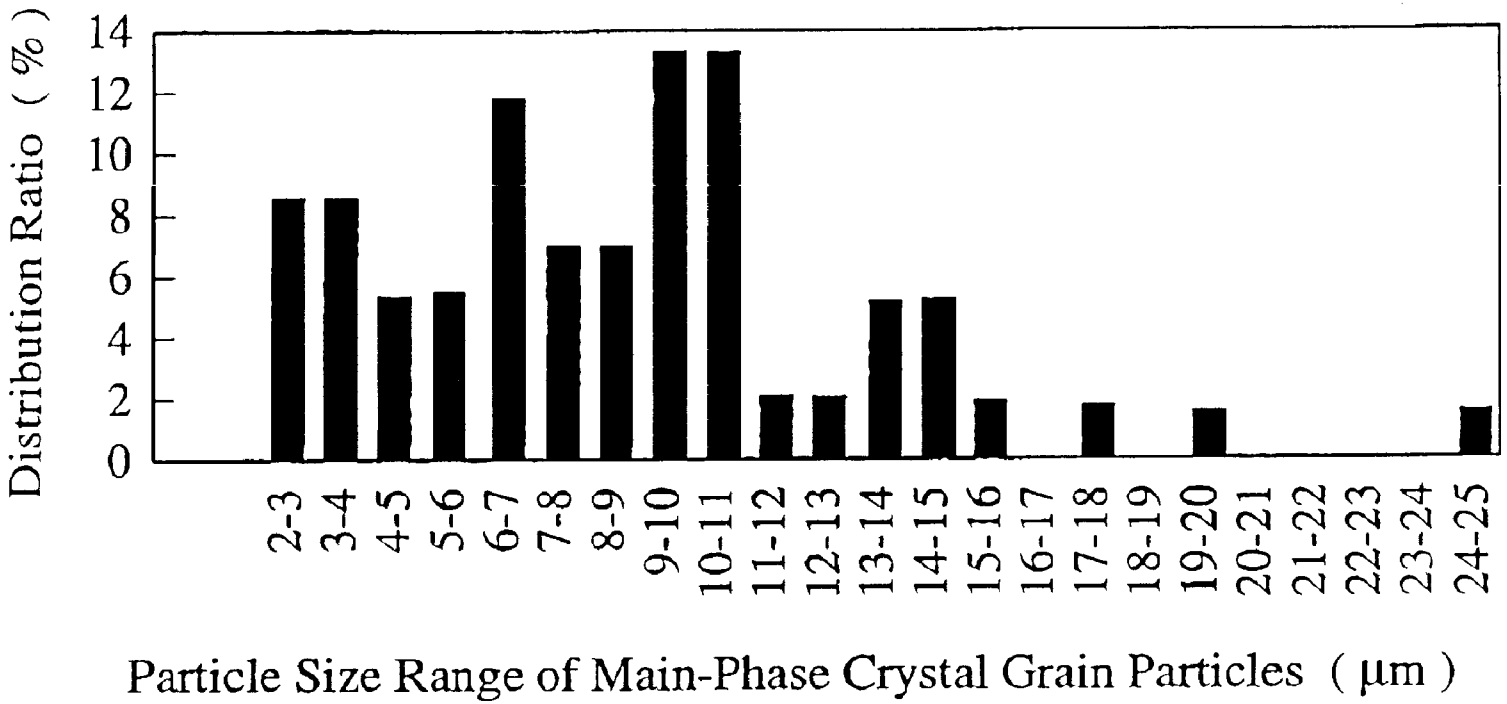
FIG. 5 is a graph showing the particle size distribution of main-phase crystal grain particles in the R—T—B sintered permanent magnet of EXAMPLE 7.

With respect to a typical permanent magnet among the above permanent magnets, a particle size distribution of the main-phase crystal grain particles is shown in FIG. 5. In FIG. 5, the axis of abscissas represents a particle size range of main-phase crystal grain particles. For instance, "9–10 μm" means that the particle size range of main-phase crystal grain particles is 9 μm or more and less than 10 μm. The particle size of main-phase crystal grain particles was determined by taking a photomicrograph (magnification: 1000) of an arbitrary cross section of the permanent magnet by an optical microscope (UFX-II, available from Nikon), and image-treating this photomicrograph by an image treatment software (image Pro. Plus (DOS/V), available from Planetron). Assuming that each main phase crystal grain particle has a circular cross section having an area Si measured by image treatment, a particle size $d_i$ of each main phase crystal grain particle is defined as $(4\times S_i+\pi)^{1/2}$. The axis of ordinates represents a distribution ratio (%), a ratio of the number $T_N$ of main-phase crystal grain particles in each particle size range to the total number T of main-phase crystal grain particles in a visional field measured: $[T_N/T)\times 100\%]$.

As is clear from FIG. 5, in the permanent magnet of the present invention, the distribution ratio of main-phase crystal grain particles was 0% in a particle size range of less than 2 μm, and 5.8% in a particle size range of 16 μm or more. Further investigation has revealed that when the distribution ratio of main-phase crystal grain particles is less than 5% in a particle size range of less than 2 μm and 10% or less in a particle size range of 16 μm or more, preferred magnetic properties as permanent magnets can be obtained. Further, it is preferable that the distribution ratio of main-phase crystal grain particles is 3% or less in a particle size range of less than 2 μm and 8% or less in a particle size range of 16 μm or more. Particularly preferable is that the distribution ratio of main-phase crystal grain particles is 0% in a particle size range of less than 2 μm and 6% or less in a particle size range of 16 μm or more. Incidentally, the above particle size distribution of main-phase crystal grain particles can be achieved even in the case of the Nb content of 0.01–0.6 weight %.

COMPARATIVE EXAMPLE 5

Coarse pulverization was carried out in the same manner as in EXAMPLE 7 except for using a cast alloy T having a main component composition shown in Table 12. As a result of analysis of this coarse powder with respect to composition, it was found that the main components of this coarse powder were 21.38 weight % of Nd, 7.12 weight % of Pr, 1.50 weight % of Dy, 1.03 weight % of B, 0.70 weight % of Nb, 0.08 weight % of Al, 2.00 weight % of Co, 0.08 weight % of Ga, and 0.1 weight % of Cu, the balance being substantially Fe, and that the impurities were 0.15 weight % of O, 0.01 weight % of N, and 0.02 weight % of C.

TABLE 12

| | Composition (weight %) | | | | | | | | | |
|---|---|---|---|---|---|---|---|---|---|---|
| Alloy | Nd | Pr | Dy | B | Nb | Al | Co | Ga | Cu | Fe |
| T | 21.38 | 7.12 | 1.50 | 1.03 | 0.70 | 0.08 | 2.00 | 0.08 | 0.10 | Bal. |

This coarse powder was subjected to fine pulverization to an average diameter of 4.1 μm, forming into a slurry, molding in a magnetic field, oil removal, sintering and heat treatment in the same manner as in EXAMPLE 7, thereby providing a sintered permanent magnet of Comparative Example by a single method. Analysis of this sintered permanent magnet with respect to composition indicated that the main components were 21.38 weight % of Nd, 7.12 weight % of Pr, 1.50 weight % of Dy, 1.03 weight % of B, 0.70 weight % of Nb, 0.08 weight % of Al, 2.00 weight % of Co, 0.08 weight % of Ga, and 0.1 weight % of Cu, the balance being substantially Fe, and that the impurities were 0.17 weight % of O, 0.05 weight % of N, and 0.07 weight % of C.

As a result of measuring their magnetic properties at 20° C., it was found that though this sintered permanent magnet had as high iHc as about 16 kOe, it had Br of 13.5 kG or less and $(BH)_{max}$ of 44.0 MGOe or less, smaller than those in EXAMPLE 7.

Figure 6:
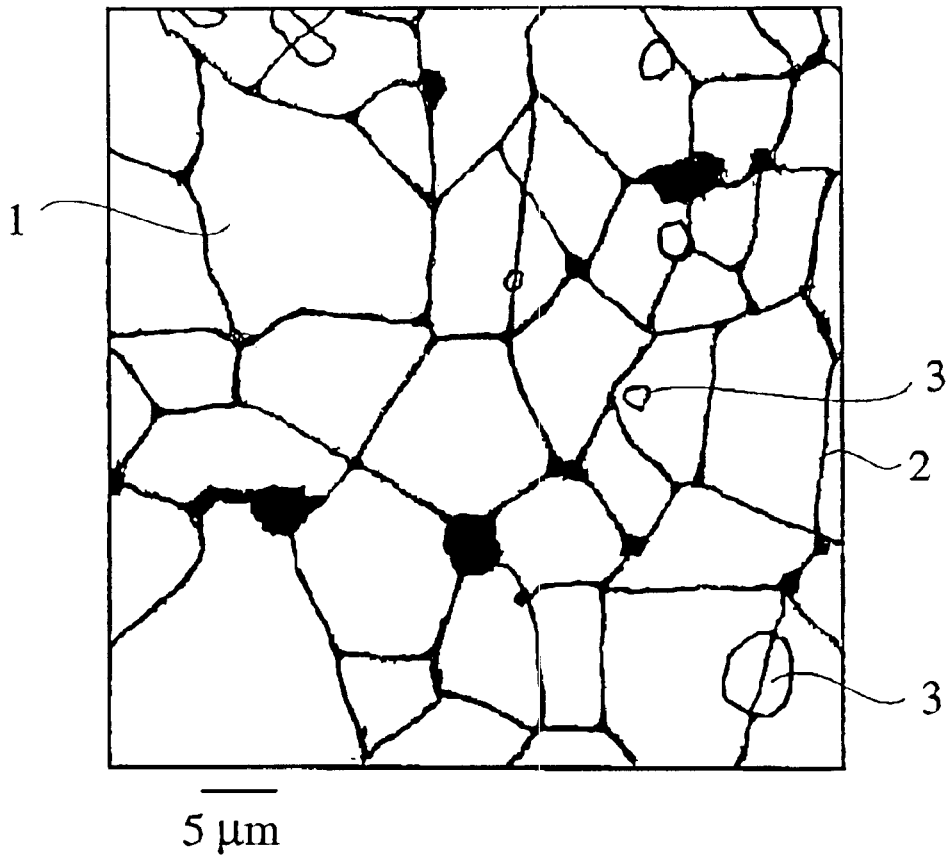
FIG. 6 is a schematic view showing the crystal structure of the R—T—B sintered permanent magnet of COMPARATIVE EXAMPLE 5.

FIG. 6 schematically shows the cross section structure of this sintered magnet. In the crystal structure, 3 denotes voids, and other numerals denote the same parts as in FIG. 4(*a*). It is clear from FIG. 6 that there were two patterns of concentration distributions of Dy, one that was substantially uniform from the crystal grain boundary phase to center portions of the main-phase crystal grain particles, and the other in which the concentration distribution of Dy was higher in the crystal grain boundary phase and lower substantially in center portions of the main-phase crystal grain particles. The number of the main-phase crystal grain particles having substantially the same Dy concentration distribution as in the crystal grain boundary phase was 31, and the number of the main-phase crystal grain particles having a lower Dy concentration than in the crystal grain boundary phase was 15. However, a concentration distribution of Dy that was higher substantially in center portions of the main-phase crystal grain particles than in the crystal grain boundary phase was not observed.

Figure 7:
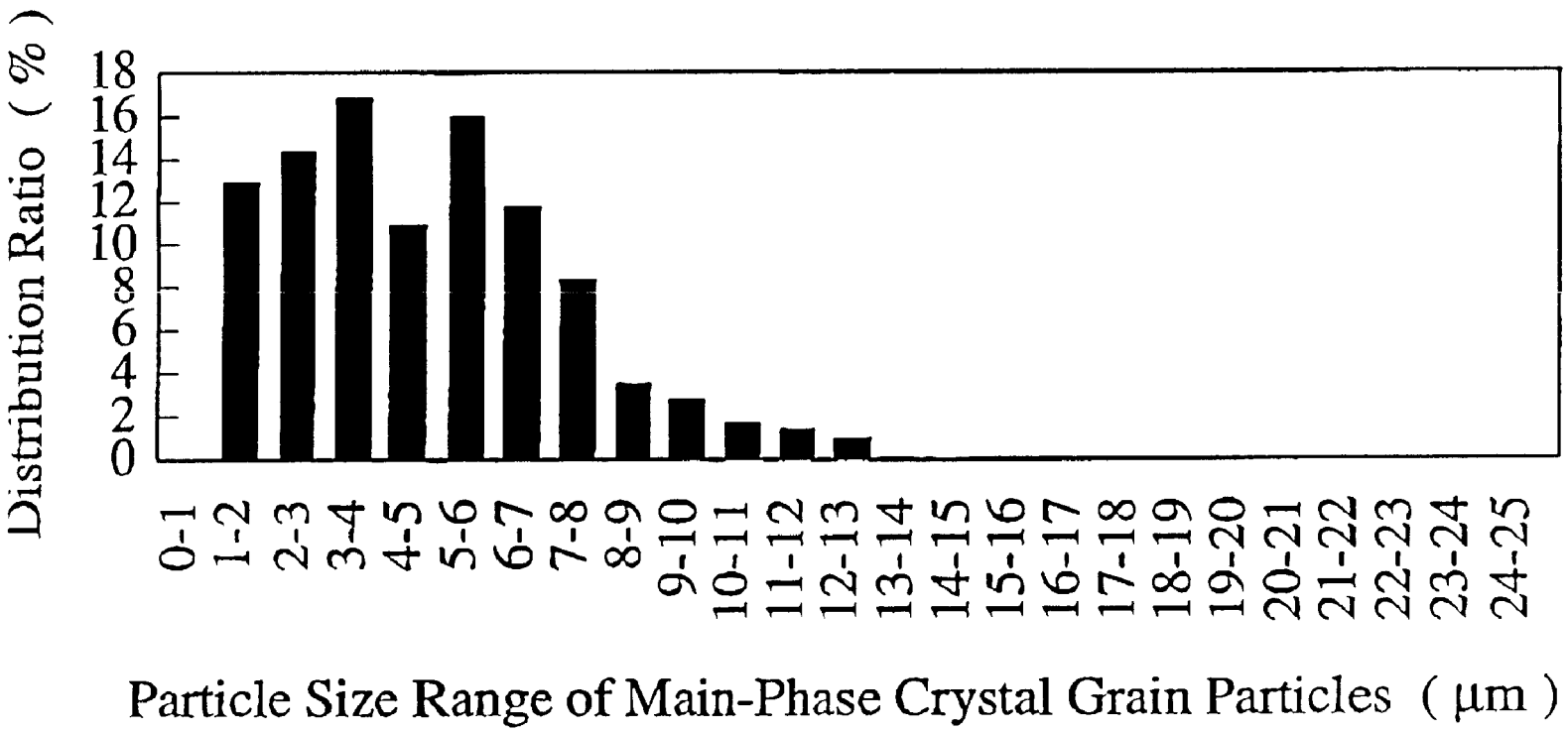
FIG. 7 is a graph showing the particle size distribution of main-phase crystal grain particles in the R—T—B sintered permanent magnet of COMPARATIVE EXAMPLE 5.

FIG. 7 shows the results of evaluating a particle size distribution of main-phase crystal grain particles in the sintered magnet of this Comparative Example in the same manner as in EXAMPLE 7. It is clear from FIG. 7 that a distribution ratio of main-phase crystal grain particles in a particle size range of 1 μm or more and less than 2 μm was 12.5%, largely shifting toward a smaller distribution ratio side. This suggests that the main-phase crystal grain particles did not fully grow. It is thus considered that Br and $(BH)_{max}$ in this Comparative Example were smaller than those in EXAMPLE 7.

As two types or more of R—T—B alloys to be mixed for the production of the permanent magnets of the present invention, thin alloy plates (stripcast alloys) illustrated by Japanese Patent 2,665,590 and 2,745,042 may be used. The thin alloy plates (stripcast alloys) can be produced by rapidly cooling alloy melts having compositions meeting the requirements of the present invention to solidification by rapid melt-quenching methods such as a single roll method, a twin roll method, a rotation disc method, etc. They have substantially uniform columnar crystal structures, an average crystal grain diameter of the columnar crystals in a shorter axis direction being 3–20 μm. To achieve high Br and $(BH)_{max}$, it is preferable to subject the thin alloy plates to a homogenization heat treatment comprising heating at 900–1200° C. for 1–10 hours in an inert gas atmosphere such as Ar and cooling to room temperature, followed by pulverization.

The above EXAMPLES illustrate Dy as a heavy rare earth element, Tb and/or Ho can also provide, like Dy, R—T—B sintered permanent magnets in which the concentration of Tb or Ho is higher in core portions of main-phase crystal grain particles than in a crystal grain boundary phase, such that they have high Br and $(BH)_{max}$, like the above EXAMPLES.

In the above EXAMPLES, two types of R—T—B alloy powder having the same main component composition except for differences in percentages of Dy, Nd, etc. constituting R elements whose total amount is the same, or two types of R—T—B alloy powder having the same main component composition except for differences in percentages of Dy, Nd, etc. constituting R elements whose total amount is the same and substitution of part of Fe with high-melting point metal elements such as Nb were mixed to stably produce R—T—B sintered permanent magnets containing main-phase crystal grain particles having a characteristic concentration distribution of Dy and thus having a main phase crystal grain particle size distribution suitable for applications requiring high Br and $(BH)_{max}$. Three types or more of R—T—B alloy powder may also be used in the present invention. Further, the mixing of these R—T—B alloy powders may be carried out at a fine pulverization step.

With various surface treatments such as Ni plating and/or epoxy resin deposition applied, the R—T—B sintered permanent magnets of the above EXAMPLES can suitably be used for various applications such as actuators of voice coil motors and CD pickups, rotors, etc.

Because the R—T—B sintered permanent magnet of the present invention contains $R_2T_{14}B$-type, main-phase crystal grain particles constituted by first $R_2T_{14}B$-type, main-phase crystal grain particles having higher concentrations of heavy rare earth elements (Dy, etc.) than those of the crystal grain boundary phase, second $R_2T_{14}B$-type, main-phase crystal grain particles having lower concentrations of heavy rare earth elements (Dy, etc.) than those of the crystal grain boundary phase, and third $R_2T_{14}B$-type, main-phase crystal grain particles having substantially the same concentrations of heavy rare earth elements (Dy, etc.) as those of the crystal grain boundary phase, they have as high iHc as that of R—T—B sintered permanent magnets produced by the single method together with Br and $(BH)_{max}$ higher than those of the latter.

What is claimed is:

1. An R—T—B sintered permanent magnet having a composition comprising 28–33 weight % of R, and 0.5–2 weight % of B, the balance being substantially T and inevitable impurities, wherein R consists essentially of at least one heavy rare earth element selected from the group consisting of Dy, Tb and Ho, and at least one rare earth element selected from the group consisting of Nd, Pr, La, Sm, Ce, Eu, Gd, Er, Tm, Yb, Lu and Y, and T is Fe or Fe and Co, said permanent magnet having a crystal structure comprising first $R_2T_{14}B$ main-phase crystal grain particles having a higher heavy rare earth element concentration than that of a crystal grain boundary phase, and second $R_2T_{14}B$ main phase-crystal grain particles having a lower heavy rare earth element concentration than that of said crystal grain boundary phase.

2. The R—T—B sintered permanent magnet according to claim 1 having a composition comprising 28–33 weight % of R, 0.5–2 weight % of B, and 0.01–0.6 weight % of $M_1$, the balance being substantially T and inevitable impurities, wherein $M_1$ is at least one element selected from the group consisting of Nb, Mo, W, V, Ta, Cr, Ti, Zr and Hf.

3. The R—T—B sintered permanent magnet according to claim 1 having a composition comprising 28–33 weight % of R, 0.5–2 weight % of B, 0.01–0.6 weight % of $M_1$, and 0.01–0.3 weight % of $M_2$, the balance being substantially T and inevitable impurities, wherein $M_1$ is at least one element selected from the group consisting of Nb, Mo, W, V, Ta, Cr, Ti, Zr and Hf, and $M_2$ is at least one element selected from the group consisting of Al, Ga and Cu.

4. The R—T—B sintered permanent magnet according to claim 1, wherein the amount of said R is more than 31% and 33% or less by weight.

5. The R—T—B sintered permanent magnet according to claim 2, wherein the amount of said R is more than 31% and 33% or less by weight.

6. The R—T—B sintered permanent magnet according to claim 3, wherein the amount of said R is more than 31% and 33% or less by weight.

7. The R—T—B sintered permanent magnet according to claim 1, comprising as inevitable impurities 0.6 weight % or less of oxygen, 0.15 weight % or less of carbon, 0.03 weight % or less of nitrogen and 0.3 weight % or less of Ca.

8. The R—T—B sintered permanent magnet according to claim 2, comprising as inevitable impurities 0.6 weight % or less of oxygen, 0.15 weight % or less of carbon, 0.03 weight % or less of nitrogen and 0.3 weight % or less of Ca.

9. The R—T—B sintered permanent magnet according to claim 3, comprising as inevitable impurities 0.6 weight % or less of oxygen, 0.15 weight % or less of carbon, 0.03 weight % or less of nitrogen and 0.3 weight % or less of Ca.

10. The R—T—B sintered permanent magnet according to claim 1, comprising as inevitable impurities 0.25 weight % or less of oxygen, 0.15 weight % or less of carbon, 0.15 weight % or less of nitrogen and 0.3 weight % or less of Ca.

11. The R—T—B sintered permanent magnet according to claim 2, comprising as inevitable impurities 0.25 weight % or less of oxygen, 0.15 weight % or less of carbon, 0.15 weight % or less of nitrogen and 0.3 weight % or less of Ca.

12. The R—T—B sintered permanent magnet according to claim 3, comprising as inevitable impurities 0.25 weight % or less of oxygen, 0.15 weight % or less of carbon, 0.15 weight % or less of nitrogen and 0.3 weight % or less of Ca.

13. The R—T—B sintered permanent magnet according to claim 1, which is produced by mixing two kinds of alloy powder wherein a concentration of a heavy rare earth element in a first alloy powder is 0–10 weight % and a concentration of a heavy rare earth element in a second alloy powder is more than 10 weight % and 40 weight % or less, wherein the ratio of the first alloy powder/the second alloy powder is 70/30 to 95/5 by weight.

* * * * *